US005647278A

United States Patent [19]

Wu

[11] Patent Number: 5,647,278

[45] Date of Patent: Jul. 15, 1997

[54] FIGURES PRINTING/CUTTING DEVICE

[76] Inventor: Ke-Teng Wu, No. 3 Sec. 3 An-Chung Road, Hsi-Hsin Li, An-Nan District, Tainan City, Taiwan

[21] Appl. No.: 645,876

[22] Filed: May 14, 1996

[51] Int. Cl.[6] ..... B41L 47/02

[52] U.S. Cl. ..... 101/368; 83/685; 30/358

[58] Field of Search ..... 101/368; 83/685; 30/358

[56] References Cited

U.S. PATENT DOCUMENTS

| | | | |
|---|---|---|---|
| 1,489,097 | 4/1924 | Nichols | 83/145 |
| 2,347,249 | 4/1944 | Brewton et al. | 83/167 |
| 3,859,726 | 1/1975 | Mitsunari | 30/358 |

FOREIGN PATENT DOCUMENTS

| | | |
|---|---|---|
| 2064406 | 6/1981 | United Kingdom . |
| 2184384 | 6/1987 | United Kingdom . |

*Primary Examiner*—Edgar S. Burr
*Assistant Examiner*—Leslie Grohusky
*Attorney, Agent, or Firm*—Bacon & Thomas

[57] ABSTRACT

A printing/cutting device includes a base member including a lower plate and an upper plate which have a receiving compartment defined therebetween for receiving a sheet of paper. A retaining member is slidably received in a receiving hole in the upper plate for retaining the sheet of paper. A printing unit includes a printing block with a desired figure formed thereon for printing the desired figure on the sheet of paper. A cutting unit includes a cylindrical hollow cutter to cut the printed figure from the sheet of paper. An actuator member is mounted on top of the cutting unit for effecting movements of the retaining member, the printing unit, and the cutting unit to perform the required functions.

3 Claims, 3 Drawing Sheets

FIGURES PRINTING/CUTTING DEVICE

BACKGROUND OF THE INVENTION

1. Field of the Invention

The present invention relates to a printing/cutting device and, more particularly, to a device which may print a specific pattern or figure and then cut it down, which is most suitable for children's use 2. Description of the Related Art For students and children, the artistic designs, manual works, or posters in schools generally have repetitive figures or patterns which often take a long time to form and cut the required figures and/or patterns, and sometimes the figures and patterns may be inadvertently damaged during cutting.

The present invention is intended to provide a printing/cutting device for figures to solve this problem.

SUMMARY OF THE INVENTION

A printing/cutting device in accordance with the present invention includes a base member including a lower plate and an upper plate which have a receiving compartment defined therebetween for receiving a sheet of paper. The upper plate includes a peripheral wall and a bottom wall which together define a receiving hole therebetween, the bottom wall of the upper plate including a first through hole which extends through the lower plate.

A retaining member is slidably received in the receiving hole and includes a second through hole defined therein which is in alignment with the first through hole. A printing unit includes a printing block with a desired figure formed thereon. A stub extends upwardly from an upper side of the printing block and includes a first elastic member therearound.

A cutting unit includes a disc having a bore defined therein and a cylindrical hollow cutter extending downwardly from an underside thereof and including a third through hole extending therethrough and having a diameter greater than that of the bore. The cylindrical hollow cutter includes a cutting edge at a bottom edge thereof and has a contour corresponding to that of the printing block, a length of the cylindrical hollow cutter being shorter than that of an overall length of the printing unit. A second elastic member is mounted around the cylindrical hollow cutter and has a first end attached to the disc and a second end attached to the retaining member for returning the retaining member to its initial position above the upper plate of the base member. The first elastic member has a first end attached to the printing block and a second end attached to the disc of the cutting unit for returning the printing unit to its initial position above the upper plate of the base member.

An actuator member has a pressing block projecting upward therefrom and is mounted on top of the disc of the cutting unit. A housing is releasably mounted to the base member for housing the retaining member, the printing unit, and the cutting unit therein. The housing includes an opening defined in an upper wall thereof through which the pressing block of the actuator member extends for manual pressing so as to urge the cutting unit to move downwardly, which, in turn, causes downward movement of the retaining member for retaining the sheet of paper in position and causes downward movement of the printing unit for printing a figure on the sheet of paper, and further downward pressing of the pressing block causes the cutting unit to move downwardly to cut the printed figure from the sheet of paper.

A third elastic member is mounted around the elastic member and has a first end attached to the disc and a second end attached to the upper plate for returning the actuator member to its initial position.

Preferably, the stub includes a distal upper end with a diameter greater than that of the bore of the cutting unit to prevent disengagement therebetween. Preferably, the peripheral wall of the upper plate includes a plurality of annularly spaced recesses, while the retaining member includes a plurality of correspondingly spaced protrusions formed on an outer periphery thereof for engaging the associated recesses, thereby being slidable in the receiving hole of the upper plate.

Other objects, advantages, and novel features of the invention will become more apparent from the following detailed description when taken in conjunction with the accompanying drawings.

DESCRIPTION OF THE PREFERRED EMBODIMENT

Figure 1:
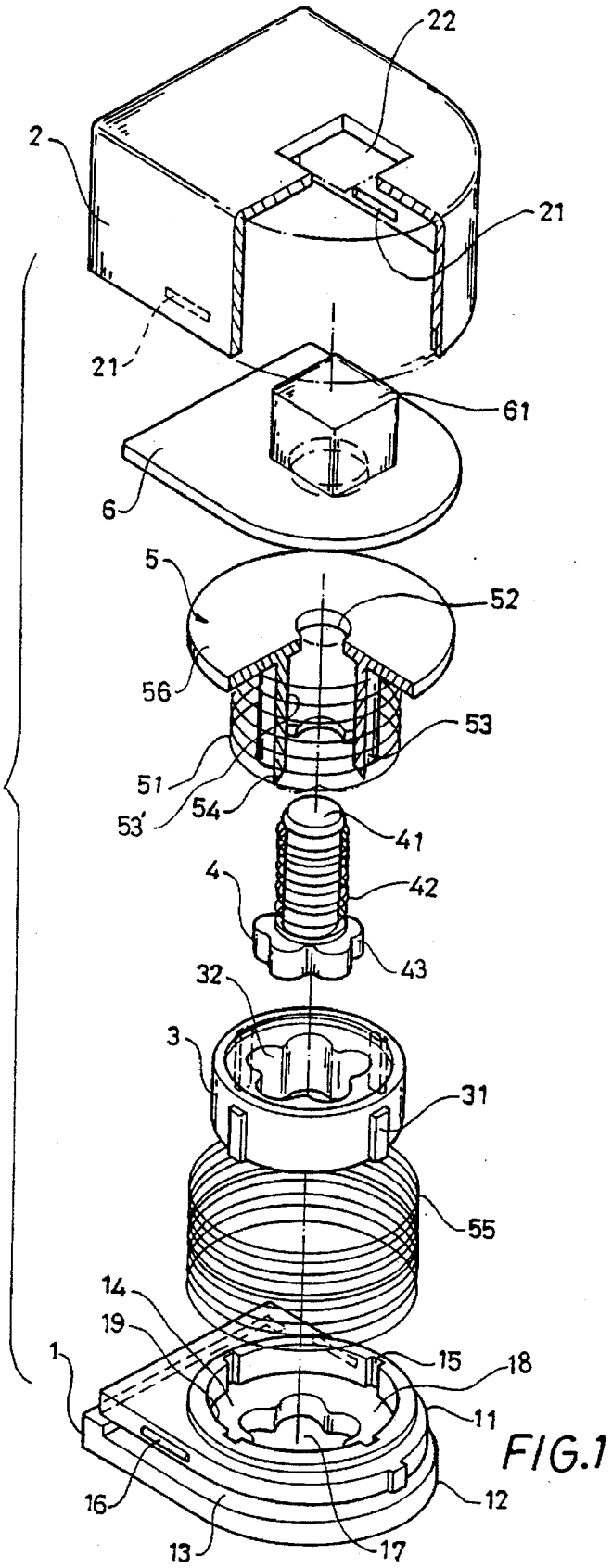
FIG. 1 is an exploded perspective view of a printing/cutting device for figures in accordance with the present invention.
Figure 2:
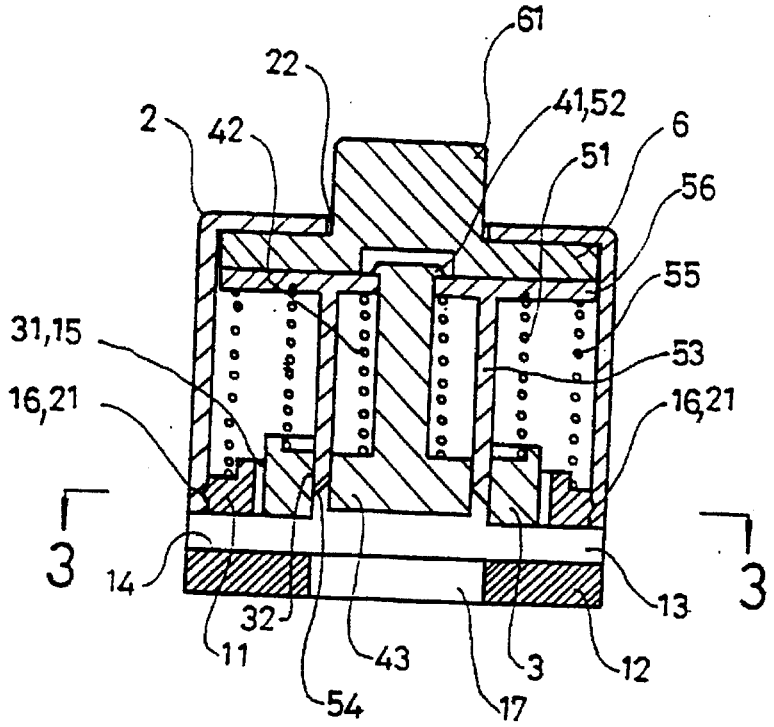
FIG. 2 is a cross-sectional view of the printing/cutting device for figures in accordance with the present invention.
Figure 3:
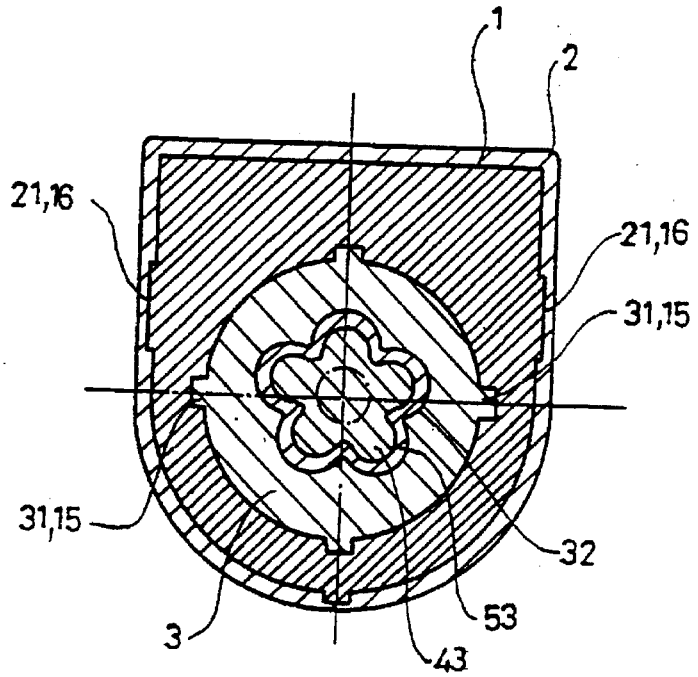
FIG. 3 is a cross-sectional view taken along line 3—3 in FIG. 2.

Referring to the drawings and initially to FIGS. 1 to 3, a printing/cutting device for figures in accordance with the present invention generally includes a base member 1, a housing 2, a retaining member 3, a printing unit 4, a cutting unit 5, and an actuator member 6.

As shown in FIGS. 1 and 2, the base member 1 includes a lower plate 12 and an upper plate 11 which have a receiving compartment 13 defined therebetween for receiving a sheet of paper to be printed. The upper plate 11 includes a receiving hole 14 defined by a peripheral wall 19 and a bottom wall 18 thereof for slidably receiving the retaining member 3 therein. The receiving hole 14 and the retaining member 3 are complimentarily formed (preferably have non-circular configurations) to guide the retaining member 3. In this embodiment, the peripheral wall 19 defining the receiving hole 14 includes a plurality of annularly spaced recesses 15, while the retaining member 3 includes a plurality of correspondingly spaced protrusions 31 formed on an outer periphery thereof for engaging the associated recesses 15, thereby being slidable in the receiving hole 14 of the upper plate 11.

The upper plate 11 further includes a first through hole 17 defined in the bottom wall 18 thereof and extending through the lower plate 12. The first through hole 17 is preferably smaller than a diameter of the retaining member 3 and is sized to allow the cutting unit 5 to fittingly pass therethrough for cutting a sheet of paper with the desired figure printed thereon. Preferably, an uppermost position of the retaining member 3 does not go beyond the receiving hole 14 and a lowermost position of the retaining member 3 may be in alignment with the lower plate 12 of the base member 1 to achieve the required retaining function. The retaining member 3 further includes a second through hole 32 defined therein through which the printing unit 4 and the cutting unit 5 extend.

The printing unit 4 includes a printing block 43 with a desired figure or pattern formed thereon, and ink can be loaded in the printing block 43 to automatically supply ink to the figure or pattern. Alternatively, the ink can be supplied by an external ink source. A stub 41 extends upwardly from an upper side of the printing block 43 and includes a first elastic member 42 (e.g., a spring) therearound.

The cutting unit 5 includes a disc 56 having a bore 52 defined therein and a cylindrical hollow cutter 53 extending downwardly from an underside thereof and including a third through hole 53' extending therethrough and having a diameter greater than that of the bore 52. The cylindrical hollow cutter 53 includes a sharp cutting edge 54 at a bottom edge thereof and has a contour corresponding to that of the printing block 43. In addition, a length of the cylindrical hollow cutter 53 is shorter than that of the overall length of the printing unit 4. A second elastic member 51 is mounted around the cylindrical hollow cutter 53 and has a first end attached to the disc 56 and a second end attached to the upper end of the retaining member 3 for returning the retaining member 3 to its initial position shown in FIG. 2. In addition, the first elastic member 42 has a first end attached to the printing block 43 and a second end attached to the disc 56 for returning the printing unit 4 to its initial position shown in FIG. 2.

The housing 2 includes at least one engaging recess 21 defined in an inner peripheral wall thereof for releasably engaging with at least one correspondingly disposed protrusion 16 formed on the base member 1. The housing 2 houses the other members therein to provide an attractive appearance and includes an opening 22 defined in an upper wall thereof.

The actuator member 6 is substantially a plate with a pressing block 61 projecting upward therefrom and extending through the opening 22 of the housing 2. The actuator member 6 is mounted on top of the disc 56 of the cutting unit 5 so as to urge the cutting unit 5 to move downwardly when the pressing block 61 is manually pressed. If necessary, the actuator member 6 may be integrally formed with the cutting unit 5.

Referring to FIG. 2, a third elastic member 55 is mounted around the elastic member 51 and has a first end attached to the disc 56 and a second end attached to the upper plate 11 for returning the actuator member 6 to its initial position shown in FIG. 2 (i.e., extending beyond the opening 22 of the housing 2) in which the cutting unit 5 and the printing unit 4 are above the upper plate 1.

Figure 4:
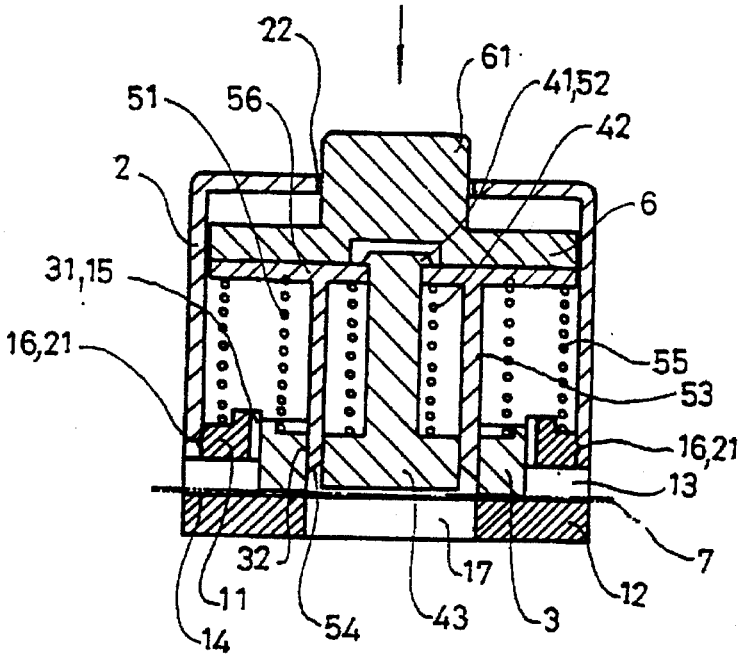
FIG. 4 is a cross-sectional view illustrating printing of a figure on a sheet of paper.

In operation, referring to FIG. 4, a sheet of paper 7 is firstly inserted into the receiving compartment 13. Then, the pressing block 61 of the actuator member 6 is pressed downwardly to urge the cutting unit 5 to move downwardly, which, in turn, causes downward movements of the retaining member 3 and the printing unit 4 to a position shown in FIG. 4, in which the sheet of paper is retained by the retaining member 3 and the printing block 43 of the printing unit 4 prints a figure on the sheet of paper, yet the cutting edge 54 of the cutting unit 5 is still above the sheet of paper.

Figure 5:
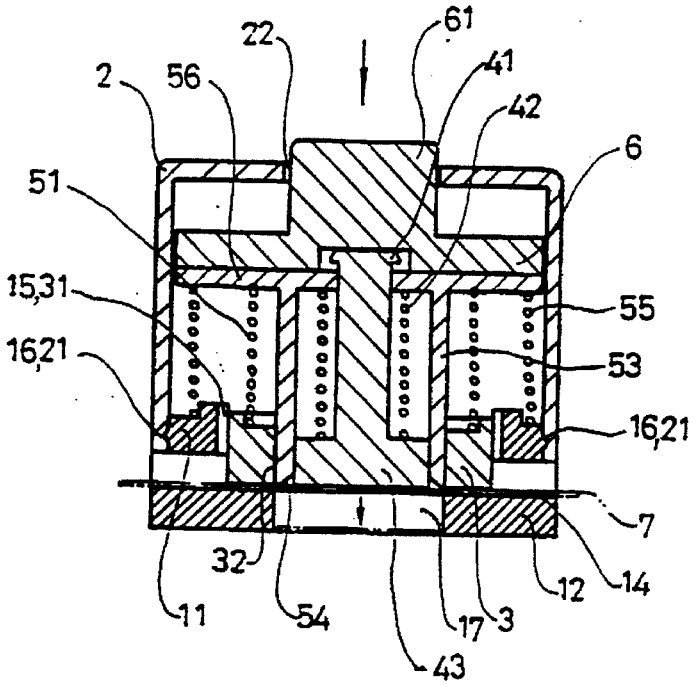
FIG. 5 is a cross-sectional view illustrating cutting of the sheet of paper containing the required figure.

Referring to FIG. 5, further downward pressing on the pressing block 61 causes the cutting unit 5 to move further downwardly, thereby cutting the sheet of paper with the desired figure. Release of the pressing block 61 allows the retaining member 3, the printing unit 4, the cutting unit 5, and the actuator member 6 to return to their initial positions under the action of the spring forces.

It is appreciated that, as can be seen in FIGS. 4 and 5, a distal upper end of the stub 41 has an enlarged head with a diameter greater than that of the bore 52 of the cutting unit 5 to prevent disengagement therebetween.

Accordingly, it is appreciated that the present device allows duplication and exact cutting of the required figures or patterns, which is very useful for students and children when doing artistic designs, manual works, or posters.

Although the invention has been explained in relation to its preferred embodiment, it is to be understood that many other possible modifications and variations can be made without departing from the spirit and scope of the invention as hereinafter claimed.

What is claimed is:

1. A printing/cutting device comprising:

a base member including a lower plate and an upper plate, a receiving compartment being defined between the upper plate and the lower plate for receiving a sheet of paper, the upper plate including a peripheral wall and a bottom wall which together define a receiving hole therebetween, the bottom wall of the upper plate including a first through hole which extends through the lower plate;

a retaining member slidably received in the receiving hole and including a second through hole defined therein which is in alignment with the first through hole;

a printing unit including a printing block with a desired figure formed thereon, a stub extending upwardly from an upper side of the printing block and including a first elastic member therearound;

a cutting unit including a disc having a bore defined therein and a cylindrical hollow cutter extending downwardly from an underside thereof and including a third through hole extending therethrough and having a diameter greater than that of the bore, the cylindrical hollow cutter including a cutting edge at a bottom edge thereof and having a contour corresponding to that of the printing block, a length of the cylindrical hollow cutter being shorter than that of an overall length of the printing unit, a second elastic member being mounted around the cylindrical hollow cutter and having a first end attached to the disc and a second end attached to the retaining member for returning the retaining member to its initial position above the upper plate of the base member, the first elastic member having a first end attached to the printing block and a second end attached to the disc of the cutting unit for returning the printing unit to its initial position above the upper plate of the base member;

an actuator member having a pressing block projecting upward therefrom and mounted on top of the disc of the cutting unit;

a housing releasably mounted to the base member for housing the retaining member, the printing unit, and the cutting unit therein, the housing including an opening defined in an upper wall thereof through which the pressing block of the actuator member extends for manual pressing so as to urge the cutting unit to move downwardly, which, in turn, causes downward movement of the retaining member for retaining the sheet of paper in position and causes downward movement of the printing unit for printing a figure on the sheet of paper, and further downward pressing of the pressing block causes the cutting unit to move downwardly to cut the printed figure from the sheet of paper; and a third elastic member mounted around the second elastic member and having a first end attached to the disc and a second end attached to the upper plate for returning the actuator member to its initial position.

2. The printing/cutting device as claimed in claim 1, wherein the stub includes a distal upper end with a diameter greater than that of the bore of the cutting unit to prevent disengagement therebetween.

3. The printing/cutting device as claimed in claim 1, wherein the peripheral wall of the upper plate includes a plurality of annularly spaced recesses, while the retaining member includes a plurality of correspondingly spaced protrusions formed on an outer periphery thereof for engaging the associated recesses, thereby being slidable in the receiving hole of the upper plate.

* * * * *